US007570137B2

(12) United States Patent
Kintis et al.

(10) Patent No.: US 7,570,137 B2
(45) Date of Patent: Aug. 4, 2009

(54) MONOLITHIC MICROWAVE INTEGRATED CIRCUIT (MMIC) WAVEGUIDE RESONATORS HAVING A TUNABLE FERROELECTRIC LAYER

(75) Inventors: Mark Kintis, Manhattan Beach, CA (US); Flavia S. Fong, Monterey Park, CA (US); Thomas T. Y. Wong, Skokie, IL (US); Xing Lan, La Palma, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 263 days.

(21) Appl. No.: 11/288,049

(22) Filed: Nov. 14, 2005

(65) Prior Publication Data

US 2007/0109078 A1 May 17, 2007

(51) Int. Cl.
*H01P 7/06* (2006.01)

(52) U.S. Cl. ..... 333/230; 333/231; 333/235; 331/96

(58) Field of Classification Search ..... 333/219.1, 333/230, 235, 231, 99 S; 331/96
See application file for complete search history.

(56) References Cited

U.S. PATENT DOCUMENTS 5,459,123 A * 10/1995 Das ..... 505/210
5,821,836 A * 10/1998 Katehi et al. ..... 333/202
5,935,910 A * 8/1999 Das ..... 505/210
6,097,263 A * 8/2000 Mueller et al. ..... 333/17.1
6,356,172 B1 * 3/2002 Koivisto et al. ..... 333/231
6,362,706 B1 * 3/2002 Song et al. ..... 333/219
6,411,182 B1 * 6/2002 Song et al. ..... 333/219
2004/0135655 A1 * 7/2004 Petrov et al. ..... 333/235

FOREIGN PATENT DOCUMENTS

WO WO 96/42118 A 12/1996

OTHER PUBLICATIONS

Christophe A. Tavernier, et al: "A Reduced-Size Silicon Micromachined High-Q Resonator at 5.7 GHz"; IEEE Transactions on Microwave Theory and Techniques, IEEE Service Center, Piscataway, NJ, US, vol. 50, No. 10, Oct. 2002, XP011076720, ISSN: 0018-9480; Abstract; Fig. 3; Paragraphs [I. Introduction], [IV. Fabrication].

(Continued)

*Primary Examiner*—Benny Lee
(74) *Attorney, Agent, or Firm*—Tarolli, Sundheim, Covell & Tummino LLP

(57) ABSTRACT

A ferroelectric loaded waveguide resonator capable of operation at microwave, millimeter-wave and higher frequencies and suitable for integration into a three-dimensional monolithic microwave integrated circuit (3D MMIC) is disclosed. The resonator includes a resonator cavity, which, in one form of the invention, is formed by two parallel metal layers and a metallized wall structure extending between the metal layers. The cavity is filled with dielectric material and includes a layer of ferroelectric material, which is used to control the resonant frequency by varying a voltage bias applied to the ferroelectric layer. The cavity includes a slot in one of the metal layers and a coupling strip formed adjacent to the slot to provide electromagnetic coupling to other components, such as a voltage controlled oscillator (VCO). The invention can also be applied to other multi-metal semiconductor or wafer level packaging technologies.

16 Claims, 3 Drawing Sheets

OTHER PUBLICATIONS

Yasunaga T et al Institute of Electrical and Electronics Engineers: "A Fully Integrated PLL Frequency Synthesizer LSI for Mobile Communication System"; 2001 IEEE Radio Frequency Integrated Circuits (RFIC) Symposium. Digest of Papers, Phoenix, AZ, May 20-22, 2001, IEEE Radio Frequency Integrated Circuits Symposium, New York, NY, IEEE, US, May 20, 2001, pp. 65-68, XP010551323, ISBN: 0-7803-6601-8; paragraph [Introduction].

Song I et al: "Phase Noise Enhancement of the GAAS High Electron Mobility Transistors Using Micromachined Cavity Resonators at Ka-Band"; Japanese Journal of Applied Physics, Japan Society of Applied Physics, Tokyo, JP, vol. 38, No. 6A/B, Part 2, Jun. 15, 1999, pp. L601-L602, XP000902417, ISSN: 0021-4922, p. L601, col. 1; Fig. 1.

International Search Report for corresponding PCT/US2006/044103, completed Mar. 9, 2007 by Holger Jaschke of the EPO.

* cited by examiner

MONOLITHIC MICROWAVE INTEGRATED CIRCUIT (MMIC) WAVEGUIDE RESONATORS HAVING A TUNABLE FERROELECTRIC LAYER

BACKGROUND OF THE INVENTION

This invention relates generally to 3-dimensional waveguide resonators and, more particularly, to waveguide resonators suitable for applications in the microwave bands and beyond. High-Q resonators are critical components of voltage controlled oscillators (VCOs) and filters, which are widely used in communication systems. There is an ongoing trend in communication systems to utilize higher frequencies. Higher frequencies are not only a less congested area of the radio frequency (RF) spectrum, but also provide technical advantages such as increased bandwidth and increased reliability for military and commercial applications.

A common measure of the performance of a resonator is its quality factor, or Q factor. Basically, the Q factor is a measure of the sharpness of resonance of a resonator. A device with a high Q factor has a sharp, well defined resonance at certain frequency. The Q factor may also be defined as the ratio of the stored energy to the dissipated energy in one cycle. The Q factor is then determined by the cavity loss of the cavity. It is a measure for the damping of waveguide modes. The higher the value of Q, the less loss or damping effect. Unfortunately, it becomes increasingly difficult to design high-Q resonators as the frequency increases. At millimeter wave frequencies, for example, there are a number of important applications of resonators, but conventional implementations using dielectric resonators (DR) or coaxial ceramic resonators (CCR) become impractical due to manufacturing limitations. Generally speaking, a millimeter wave has a wavelength in the range of 1 mm to 0.1 mm and a frequency in the range of 300 gigahertz (GHz) to 3,000 GHz.

The conventional DR and CCR approaches have several disadvantages. The first is lack of tunability. Most existing resonators are not electronically tunable. Frequency tuning generally involves mechanical tuning of the resonator structures, which is tedious, costly and challenging.

A second disadvantage of conventional resonator approaches is their difficulty of manufacturability and ability to be manufactured repeatably. The dimensions of resonators become too small to be practical for DRs and CCRs at frequencies above 40 GHz. Most existing high-Q resonators are implemented "off-chip," that is to say separately from other related components. When connecting to oscillators or to other MMICs (monolithic microwave integrated circuits), ribbons or bond wires are used. These not only introduce parasitic impedance effects, but also greatly reduce the repeatability of the overall circuit's performance and tunability.

Prior to the present invention, most existing monolithically integrated resonators were of a planar type. Planar resonators inherently have a relatively low Q factor, resulting in poor phase noise for a VCO of which such a resonator is a part, and in compromised insertion loss and rejection for filter applications of the resonators.

Yet another disadvantage of resonators of the prior art is their overall high cost. Scaling DRs and CCRs down in size for higher frequencies of operation is not only technically difficult, but it leads inherently to higher manufacturing cost.

Accordingly, there is a real need for a new approach to resonator construction that lends itself more readily to scaling to increasingly high frequencies, that is electronically tunable and, ideally, that still maintains a high Q factor. The present invention meets these requirements, as will become apparent from the following summary.

SUMMARY OF THE INVENTION

The present invention is embodied in a tunable, monolithic, and high-Q waveguide resonator, capable of operation at radio frequencies designated as microwave, millimeter wave and beyond. Briefly, and in general terms, the invention may be defined as a monolithic 3-dimensional resonator, comprising a waveguide defining a resonator cavity formed within a three-dimensional integrated circuit structure; means for electromagnetically coupling the resonator cavity to other components in the integrated circuit structure; a ferroelectric layer formed in the resonator cavity; and means for voltage biasing the ferroelectric layer to effect a desired change in resonator frequency characteristics. Varying the bias voltage applied to the ferroelectric layer changes the dielectric properties of the cavity and, therefore, the resonant frequency. In this way the resonator is electronically tunable.

In the illustrated embodiment of the invention the waveguide is formed by a three-dimensional monolithic microwave integrated circuit (3D MMIC) technology, such as multi-layer metal (MLM) processing.

More specifically, the resonator cavity is defined by parallel first and second metal layers separated by a dielectric region; and metallized walls extending between the first and second metal layers. Coupling with the resonator is effected by means of a slot formed in one of the first and second metal layers; and a coupling strip extending over the slot in an overlapping configuration, but separated from the slot by another dielectric region.

The metallized walls of the resonator cavity may form a waveguide cavity of rectangular cross section, or of circular cross section, or of some other shape.

The ferroelectric layer is, for example, formed as a layer of barium strontium titanate ($Ba_xSr_{1-x}TiO3$), generally known by the acronym BST.

Because the resonator may be conveniently integrated with a device with which it is coupled, such as a VCO, losses associated with coupling to external devices are eliminated. Moreover, the integrated nature of the resonator and devices to which it is coupled results in simplification of the manufacturing process. The resonator is frequency tunable by conveniently adjusting a bias voltage applied to the ferroelectric layer, and the entire resonator structure is easily scalable to produce extremely high frequencies, such as millimeter-wave frequencies. Because of the frequency tuning function, the device of the invention is highly suited to applications in which the frequency is switched rapidly for security or other purposes.

It will be appreciated from the foregoing that the present invention represents a significant advance in the field of microwave/millimeter wave resonators. In particular, the ability of the invention to integrate a resonator with other high frequency components, such as VCOs, affords manufacturing economies. The ability to vary the frequency of operation electronically allows the invention to be used in applications requiring agile frequency switching during operation. Other aspects and advantages of the invention will become apparent from the following more detailed description, taken in conjunction with the accompanying drawings.

DETAILED DESCRIPTION OF THE INVENTION

Figure 1:
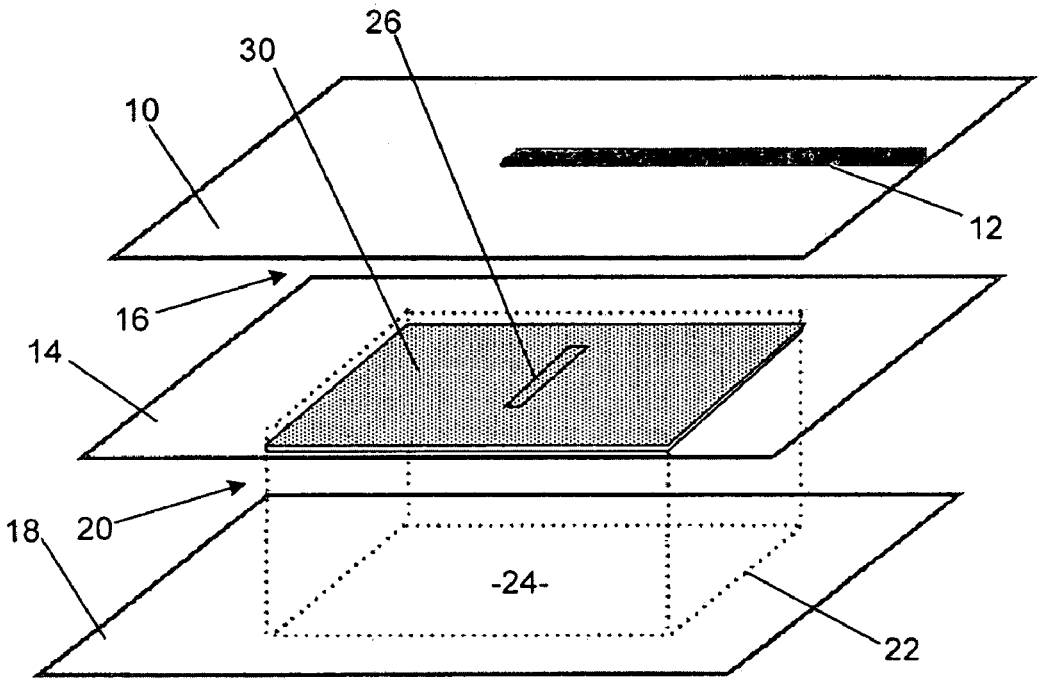
FIG. 1 is a diagrammatic perspective view of an integrated resonator in accordance with the present invention.

As shown in the drawings for purposes of illustration, the present invention pertains to radio frequency waveguide resonators. As discussed more fully above, conventional approaches to producing resonators have serious shortcomings when applied to extremely high frequencies. In accordance with the present invention, the disadvantages of the prior art resonators are overcome by providing a high-Q waveguide resonator that is conveniently integrated into a MMIC (monolithic microwave integrated circuit) structure with other related components, is conveniently tunable in resonant frequency, and can be produced reliably and at relatively low cost.

Figure 1A:
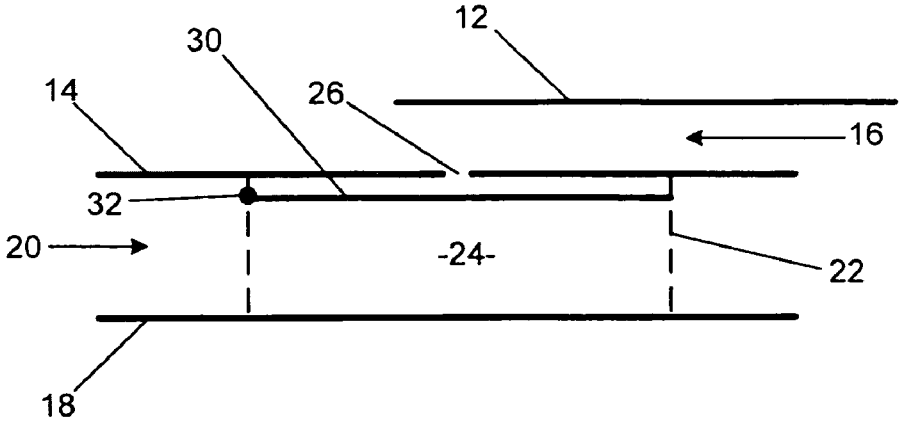
FIG. 1A is a diagrammatic elevational view of the resonator of FIG. 1

As shown in FIGS. 1 and 1A, one preferred embodiment of the invention uses a MMIC technique known as multi-layer metal (MLM). The resonator structure depicted includes a first metal layer 10 of FIG. 1 comprising a coupling strip 12 that provides external connection of the resonator to a voltage controlled oscillator (VCO) or other device. A second metal layer 14 is spaced from the first layer 12 by a dielectric region 16, which is indicated only by spacing between the layers 12 and 14. A third metal layer 18 is similarly separated from the second layer 14 by another dielectric region 20. Formed within the second dielectric region 20 is a rectangular waveguide 22, with four sidewalls extending between the metal layers 14 and 18. The waveguide 22 defines a rectangular waveguide cavity 24 between the metal layers 14 and 18. A coupling slot 26 is formed in second metal layer 14 and provides, in part, means for electromagnetically coupling to the cavity 24. The coupling strip 12 overlaps the coupling slot 26 and completes the means for coupling microwave/millimeter wave energy to and from the resonator cavity 24. As depicted and described, the resonator of the invention is assumed to be a passive one-port resonator coupled to a VCO (not shown in FIGS. 1 and 1A). It will be understood, of course, that the resonator may be configured differently for other applications.

Enclosed within the cavity 24 is a ferroelectric material layer 30, which is deposited over dielectric material within the cavity. For example, the ferroelectric material may be BaxSr1-xTiO3 (barium strontium titanate), generally known as BST. An electrical bias connection, at node 32, is made to the ferroelectric layer 30, such as by means of a conventional metallized via. By applying a direct (DC) control voltage to the ferroelectric layer 30, the dielectric constant of the layer is varied due to electric field changes in the ferroelectric material. It is known in the art that these changes are caused by spontaneous dielectric polarization of the ferroelectric material. The bias voltage may be conveniently applied to the ferroelectric layer 30 through a conventional metallized via structure. Varying the electrical bias applied to the ferroelectric layer 30 provides a convenient technique for frequency tuning of the resonator. Since there is no load current associated with the bias voltage, the tuning is accomplished without any additional energy cost.

It is well known in the art of resonators that variation of the dielectric constant of a resonant cavity effects corresponding changes in the frequency characteristics of the resonator. Two important frequency characteristics of a resonator are the resonant frequency and the cutoff frequency. The resonant frequency is the frequency at which the inductive reactance and the capacitive reactance are of equal magnitude, causing the stored energy to oscillate between the magnetic energy and electrical energy. The cutoff frequency is the lowest frequency for a certain mode can propagate inside a waveguide. The wave's frequency has to be higher than this cutoff frequency to be able to propagate.

Figure 2:
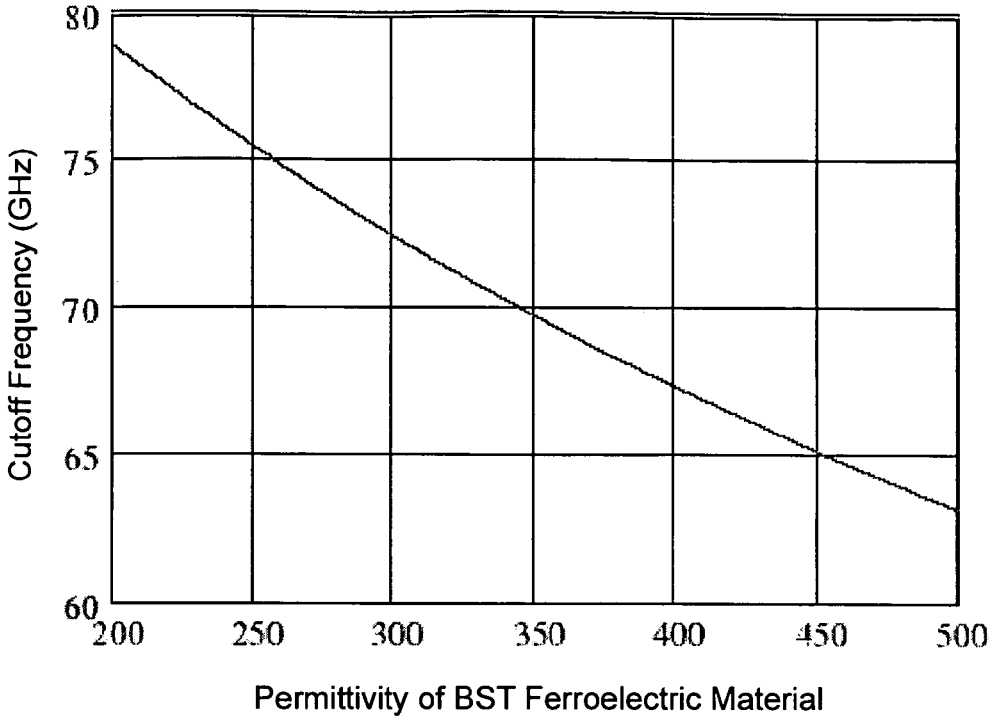
FIG. 2 is a graph showing the variation of resonator cutoff frequency with ferroelectric material permittivity.
Figure 3:
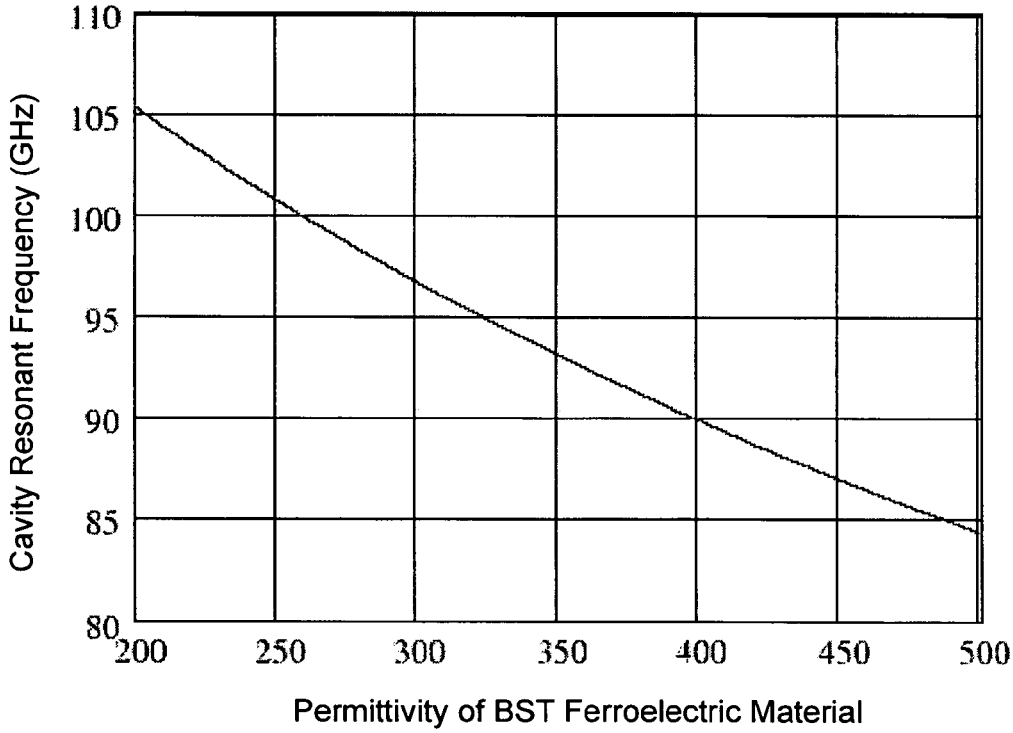
FIG. 3 is a graph showing the variation of cavity resonant frequency with ferroelectric material permittivity.

FIGS. 2 and 3 illustrate the effect the permittivity of a BST ferroelectric layer 30 on the lower cutoff frequency and the resonant frequency, respectively. These graphs were simulated assuming the dimensions of the resonator cavity 24 to be 450 μm (width)×60 μm (height)×508 μm (length).

Figure 4:
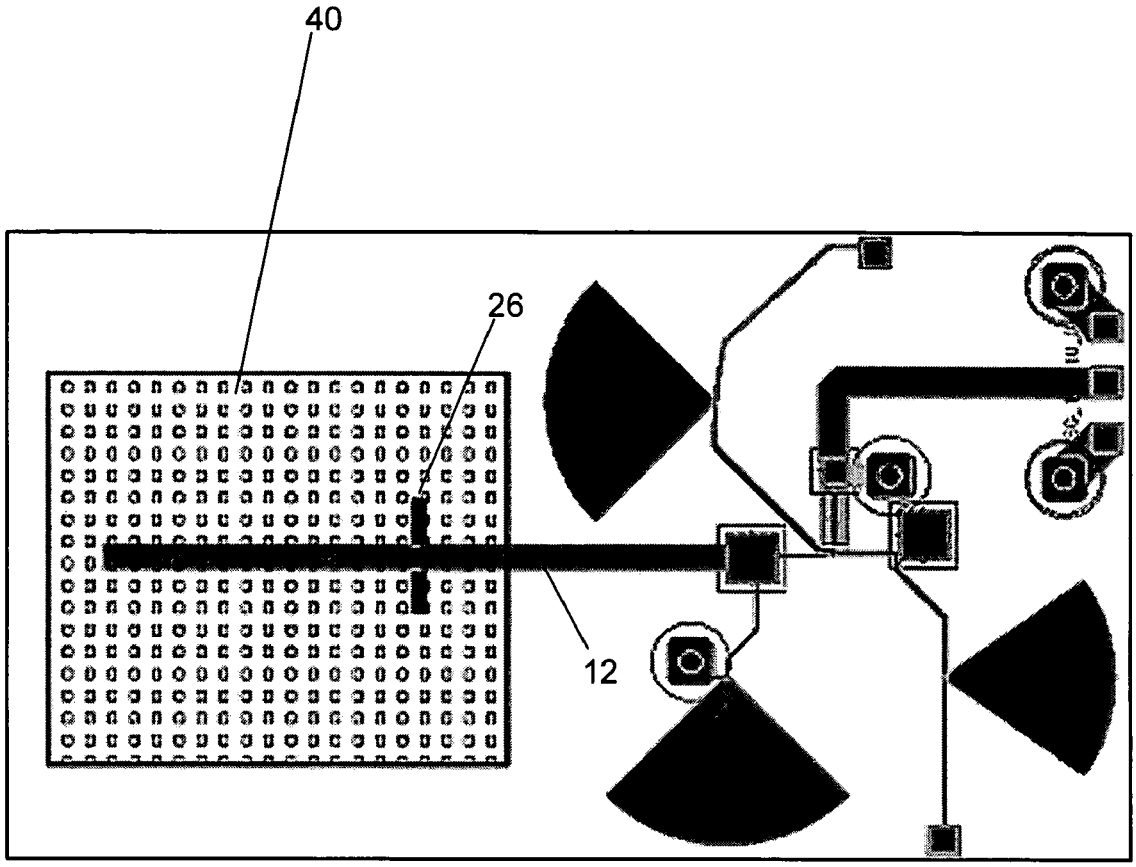
FIG. 4 is a plan view of an integrated circuit that includes an resonator, a voltage controlled oscillator (VCO), and associated circuitry, all integrated on a single semiconductor chip.

FIG. 4 shows diagrammatically how the resonator of the invention may be fully integrated with a MMIC voltage controlled oscillator (VCO) on the same semiconductor chip. The rectangular shape 40 at the left is the resonator of the invention. The remainder of the components, on the right, are a VCO and biasing circuitry. A coupling strip 12 provides an external connection from the resonator 40 to a VCO or other device.

The multi-layer metal (MLM) technique described for this embodiment of the invention is one type of three-dimensional (3D) MMIC technology. Another 3D MMIC technology is wafer level packaging (WLP), which may also be employed in accordance with the invention, to produce a monolithically integrated waveguide cavity on-chip. The commonality of the two 3D technologies is that both involve formation of a waveguide cavity inside of which a ferroelectric layer is formed together with multiple dielectric layers, and both provide for application of a DC bias voltage to the ferroelectric layer, to vary its dielectric constant and thereby vary the frequency characteristics of the resonator.

The coupling level is primarily determined by the length of the coupling slot 26. The width of the slot also affects the coupling level, but to a much less degree than the slot length. Varying the bias voltage applied to the ferroelectric layer 30 provides for rapid tuning over a wide range of frequencies, during operation of the resonator. Therefore, the resonator of the invention is particularly useful as a frequency agile component, such as in frequency hopping applications. Its other principal advantage is its integration with other MMIC components, such as VCOs. This renders the device much less sensitive to circuit parasitic impedances and improves production yield and repeatability. Further, the resonator of the invention has a much higher Q-factor than its counterparts in the prior art that use planar technology. The resonator of the invention provides these advantages at lower manufacturing cost than the prior art techniques.

It will be appreciated from the foregoing that the present invention represents a significant advance in the field of resonators for use at extremely high frequencies. In particular, the resonator of the invention may be fully integrated with associated components and fabricated using known 3D MMIC technologies. Importantly, the resonator of the invention is electronically tunable over a wide range of frequencies, making it highly suited for a variety of military and commercial applications.

What have been described above are examples of the present invention. It is, of course, not possible to describe every conceivable combination of components or methodologies that fall within the scope of the present invention, but one of ordinary skill in the art will recognize that many further combinations and permutations of the examples of the present invention are possible. Accordingly, the present invention is intended to embrace all such alterations, modifications and variations that fall within the spirit and scope of this disclosure.

The invention claimed is:

1. A monolithic resonator, comprising:

a waveguide defining a resonator cavity located within a three-dimensional integrated circuit chip, wherein the resonator cavity has a height, width and length, and at least one of the width and length is greater than 200 micrometers;

means for electromagnetically coupling the resonator cavity to other components in the integrated circuit chip;

a ferroelectric layer located in the resonator cavity; and means for voltage biasing the ferroelectric layer to effect a desired change in resonator frequency characteristics, whereby the resonator is electronically tunable.

2. A monolithic resonator as defined in claim 1, wherein the waveguide is a three-dimensional monolithic microwave integrated circuit (3D MMIC) structure.

3. A monolithic resonator as defined in claim 2, wherein the waveguide is a multi-layer metal (MLM) structure.

4. A monolithic resonator as defined in claim 3, wherein the resonator cavity is defined by:

parallel first and second metal layers separated by a dielectric region; and metallized walls extending between the first and second metal layers.

5. A monolithic resonator as defined in claim 4, wherein the means for electromagnetically coupling comprises:

a slot located in one of the first and second metal layers; and a coupling strip extending over the slot in an overlapping configuration, but separated from the slot by another dielectric region.

6. A monolithic resonator as defined in claim 4, wherein the metallized walls of the resonator cavity define a waveguide cavity of rectangular cross section.

7. A monolithic resonator as defined in claim 1, wherein at least one dielectric layer is located in the resonator cavity.

8. A monolithic resonator as defined in claim 1, wherein the ferroelectric layer is of barium strontium titanate ($Ba_xSr_{1-x}TiO_3$).

9. A monolithic resonator as defined in claim 1, wherein the waveguide cavity is configured to be operable at millimeter-wave frequencies.

10. A monolithic resonator as defined in claim 1, wherein the ferroelectric layer traverses an entire surface of the resonator cavity.

11. A three-dimensional monolithic microwave integrated circuit (3D MMIC) chip, comprising:

a voltage controlled oscillator (VCO); and a radio frequency resonator, integrated into a common 3D MMIC chip with the VCO wherein the radio frequency resonator further comprises:

a resonator cavity;

a ferroelectric layer within the resonator cavity that traverses an entire surface of the resonator cavity;

means supplying electromagnetic coupling between the resonator and the VCO; and means for varying the frequency of operation of the resonator by varying a bias voltage applied to the ferroelectric layer.

12. A 3D MMIC as defined in claim 10, wherein the resonator cavity is located between two generally parallel metal layers in the 3D MMIC and by metallized walls extending between the two parallel metal layers to define the cavity.

13. A 3D MMIC as defined in claim 12, wherein the metallized walls define a rectangle and the resonator cavity is a rectangular waveguide resonator.

14. A method for fabricating an electronically tunable three-dimensional monolithic microwave integrated circuit (3D MMIC) chip, comprising:

forming a waveguide defining a resonator cavity located within the 3D MMIC chip comprising:

forming a first metal layer;

forming a dielectric region overlying the first metal layer;

forming a ferroelectric layer within the dielectric region; and forming a second metal layer overlying the dielectric region and the ferroelectric layer, thereby defining the resonator cavity such that the ferroelectric layer resides within the resonator cavity;

forming a coupling to the resonator cavity; and electromagnetically coupling the waveguide to other components in the 3D MMIC chip.

15. The method of claim 14, wherein:

the first and second metal layer are parallel; and metallized walls extend between the first and second metal layers to define dimensions of the dielectric region.

16. The method of claim 15, wherein:

the first metal layer is formed on a first wafer; and the second metal layer and the ferroelectric layer are formed on a second wafer.

* * * * *